United States Patent [19]

Kamanaka et al.

[11] Patent Number: 5,062,409

[45] Date of Patent: Nov. 5, 1991

[54] HOT-AIR FURNACE

[75] Inventors: Ryusuke Kamanaka, Chigasaki; Yoshio Kakuta, Sagamihara, both of Japan

[73] Assignee: Nepon Company, Ltd, Tokyo, Japan

[21] Appl. No.: 510,294

[22] Filed: Apr. 16, 1990

[30] Foreign Application Priority Data

Aug. 17, 1989 [JP] Japan ..... 1-210658

[51] Int. Cl.[5] ..... F24H 3/00

[52] U.S. Cl. ..... 126/99 R; 126/99 D; 126/110 R; 431/159

[58] Field of Search ..... 126/99 R, 99 D, 110 R, 126/106, 102; 431/12, 159

[56] References Cited

U.S. PATENT DOCUMENTS

| | | | |
|---|---|---|---|
| 2,533,508 | 12/1950 | Riu . | |
| 2,796,860 | 6/1957 | Pinkus et al. | 126/99 |
| 3,056,400 | 10/1962 | Hammersley et al. | 126/307 |
| 3,294,082 | 12/1966 | Norris . | |
| 4,337,893 | 7/1982 | Flanders et al. . | |

FOREIGN PATENT DOCUMENTS

| | | |
|---|---|---|
| 471564 | 5/1975 | Australia . |
| 0262546 | 4/1988 | European Pat. Off. . |
| 1255084 | 1/1961 | France . |
| 823334 | 11/1959 | United Kingdom . |

OTHER PUBLICATIONS

European Search Report 11/1990.

*Primary Examiner*—Larry Jones
*Attorney, Agent, or Firm*—Edward D. C. Bartlett

[57] ABSTRACT

A hot-air furnace has a long-flame burner for combusting gas or liquid fuel with a combustion chamber connected to the burner and having its length (l) and width ($w_1$) in relationship of $w_1 < l$. A heat exchanger is located above the combustion chamber and has internally a gas flow guide plate which guides combustion gas flow discharged from the combustion chamber to the heat exchanger. The heat exchanger has a width ($w_2$) and length (l) in the relationship of $w_2 < l$. An exhaust port for exhausting the combustion gas flow is located at the front or rear of, right or left-hand side of or on the top side above said heat exchanger. A casing has a drum integrally connecting the combustion chamber and the heat exchanger, an air flow guide and directing plate which covers the drum, a radiant heat absorber plate outside the combustion chamber, and a blower above or below the drum. A discharge port is mounted in such a manner that the direction of discharging air flow corresponds to the up or down position of the blower.

20 Claims, 14 Drawing Sheets

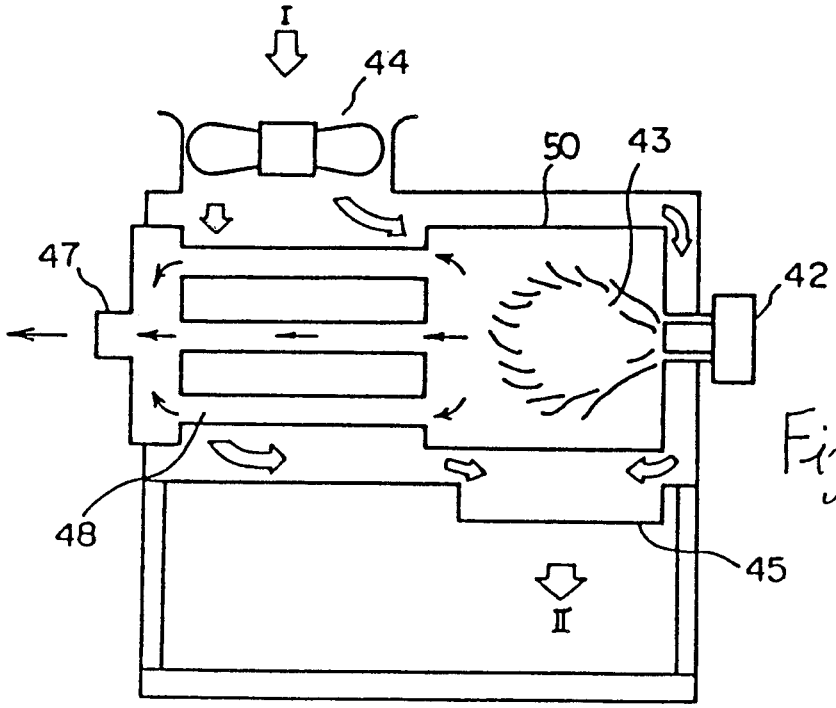
Fig. 12(c)
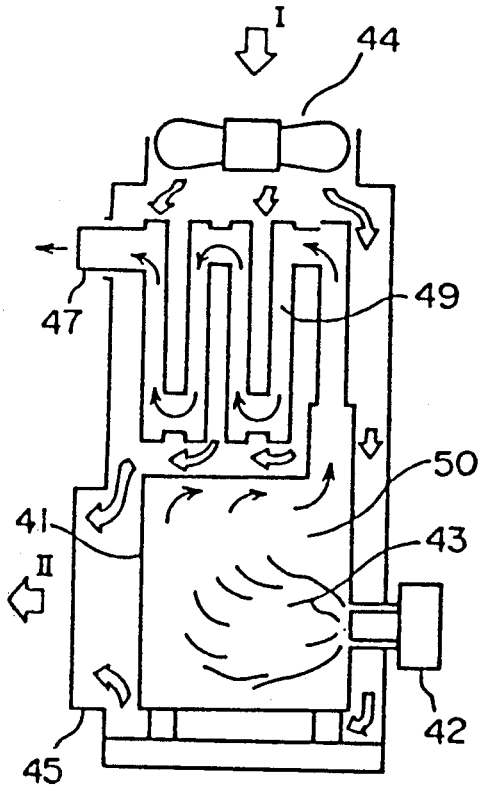
Fig. 12(d)
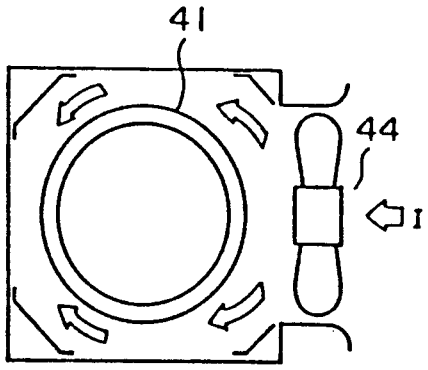
Fig. 12(e)
Fig. 12(f)
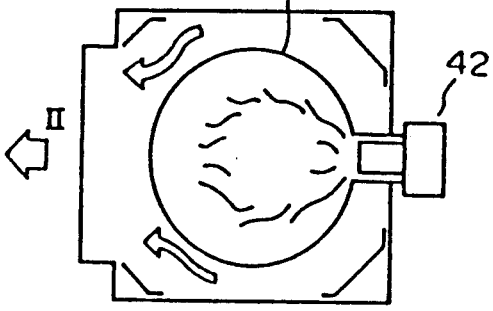

HOT-AIR FURNACE

FIELD OF THE INVENTION

This invention relates to a hot-air furnace suitable for hot-air heating of horticultural green houses in particular, ordinary buildings and factories, as well as a heat source for drying facilities in a hot-air or hot-blast system, and the like.

BACKGROUND OF THE INVENTION

Hot-air furnaces or hot-air heaters as above can be classified broadly into the following three types:

(1) a furnace, drum unified type;

(2) a furnace, combustion chamber and smoke tube type;

(3) a furnace, combustion chamber and heat exchanger type.

These three types are shown in FIGS. 12(*a*) to (*f*) of the accompanying drawings.

The furnace, drum unified type is shown in FIG. 12(*a*), in which 41 denotes a drum, 42 a burner, a 43 a flame, 44 a fan, 45 a discharge port for hot air, and 46 a thermal resisting filer. The flame 43 is generated by the burner 42 at the lower part of the drum 41, and combustion gas is heat-exchanged and loses its temperature while passing through the drum 41 and the heat resisting filler 46 at the upper part thereof, and is exhausted from an exhaust port 47. Air flow taken into the drum 41 by the fan 44, in the direction of the white arrow I, is heated while going around the drum 41, and is discharged in the direction of the white arrow II from the discharge port 45, and is then supplied to a desired place, for example, into a greenhouse, as hot air. FIGS. 12(*e*) and (*f*) are sections along the E—E and F—F in FIG. 12(*a*). In FIG. 12, solid line arrows show combustion gas flow and the white arrows, as mentioned above, air flow.

A furnace, combustion chamber and smoke tube type is shown in FIGS. 12(*b*) and (*c*). The same reference numerals are applied to the same parts as are shown in FIG. 12(*a*), and 48 denotes smoke tubes. Air taken in by the fan 44 is heat-exchanged and heated by the combustion chamber 50 and the smoke tubes 48, and is discharged from the discharge port 45. Accordingly, a hot-air furnace of this type is called a furnace, combustion chamber and smoke tube type.

Among the hot-air furnaces of the types described, the one shown in FIG. 12(*a*) was developed by the present applicant and was published in Japanese Patent Publication (Unexamined) No. 297631/1988. A furnace, combustion chamber and heat exchanger type is shown in FIG. 12(*d*), and the same reference numerals are applied to the same parts as are shown in FIG. 12(*a*). Further, 49 denotes a heat-exchanger and 50 the combustion chamber. Combustion gas generated in the combustion chamber 50 is exhausted form the exhaust port 47 via the heat-exchanger 49. While air taken in by the fan 44 as shown by the white arrow I is heat-exchanged and heated by the heat-exchanger 49, then heated further around the combustion chamber 50, and finally discharged in the direction of white arrow II from the discharge port 45.

SUMMARY OF THE INVENTION

In the combustion chamber of the conventional drum, the temperature gets high at the front part of the flame axis and, depending on the mode of use, cracks, expansion and oxidation may occur due to high temperature or heat fatigue, and there is the possibility of the drum being damaged. Furthermore, a considerable length is necessary along the flame axis, and consequently the diameter and length of the drum must also be sufficiently long.

In the construction with a heat exchanger, it is desirable to reduce more the depth, width and height, as well as to enhance further the heat transfer efficiency (high heat transmission) by accelerating turbulent flow of the air flow.

In any of the above-mentioned three furnace types, because the exhaust port is fixed at the upper part of the drum, the direction of exhaust is restricted, and because the fan is mounted at the upper part of the drum, there is a limitation on the manner of taking in the air. The drum construction, having numerous projecting parts, is subject to substantial ventilation resistance, and it interrupts the flow of air to be heated. Moreover, stagnant locations are inevitably brought about in the air flow, and a large heat transfer area is necessary. Damage due to local thermal fatigue and corrosion may easily occur. Naturally, the power for ventilation is bound to be large to secure required wind volume, which is likely to raise the noise level.

It is an object of preferred embodiments of this invention to provide a hot-air furnace wherein set-up positions of a combustion chamber, a heat exchanger, an exhaust port and a fan as well as drum construction are improved, durability is maintained and the heat transfer efficiency is enhanced, and an air-intake port, an exhaust port, the drum construction, etc. are improved so that setting up may freely be designed.

According to the present invention there is provided a hot-air furnace comprising: a long-flame burner for combustion gas or liquid fuel, a combustion chamber connected to the burner and having its length (1) and width ($w_1$) in the relationship of $w_1 < 1$, a blower located above or below a drum, a heat exchanger which is located above the combustion chamber, having inside thereof a gas flow guide plate which guides combustion gas flow discharged from the combustion chamber to the heat exchanger, and having its width ($w_2$) and length (1) in the relationship of $w_2 < 1$, an exhaust port, located at the front or rear, right or left-hand side or on the top side above said heat exchanger, for exhausting the combustion gas flow, a casing having a drum which integrally connects the combustion chamber and the heat exchanger and an air flow guide and directing plate which covers the drum and a radiant heat absorber plate, and the blower, wherein a discharge port is mounted such that the direction of discharging air flow corresponds to the up or down position of the blower.

By having a small-diameter, long-axis combustion chamber and directing air flow at right angles to the combustion chamber, high-temperature gas uniformly contacts the inside walls of the combustion chamber and, while the air flow can contact at almost right angles on an average and at high speed all over the outside walls of the combustion chamber, the temperature on the walls of the combustion chamber can be kept uniform with the cooling and heat transfer efficiencies improved, so that unusual localized heating can be avoided. Also, damage due to cracks, and expansion because of oxidation at high temperature and heat fatigue can be prevented, while high furnace load and high surface load can be realized.

As the heat exchanger is preferably thin and structured longitudinally long, its depth and width can be reduced, and by changing the height, heat output and thermal efficiency can be freely determined and adjusted.

Further, as the heat exchanger preferably has the flat-plate type heat exchanging surface structure, it is possible to provide the surface with dimples or folds to accelerate turbulent flow of the combustion gas and air flow, so that high heat transfer can be performed. And, because of occurrence of turbulent flow in the combustion gas part of the heat exchanger, it is easy to set up a guide plate for rapid rising of gas flow, improving heat transfer from gas, and the exhaust port can be placed at the top most part of the drum, allowing any sideward, upward or lateral direction with little restriction on the exhausting direction.

When an exhaust port is mounted on the burner side, socalled FF (Forced Flue) system of air supply and gas exhaust can be easily employed. The drum construction has fewer projections which resist the air flow so that ventilation resistance can be reduced, and large wind volume, reduction in noise, and economy of power for ventilation can be easily realized, and high speed air flow can be given to the heat transfer surface so that high heat transmission can be realized, and furthermore, a blower or fan can be freely placed, either at the upper part or the lower part of the furnace.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings, in which like reference characters in the same or different Figures indicate like parts.

DETAILED DESCRIPTION OF THE PREFERRED EMBODIMENTS

Figure 1A:
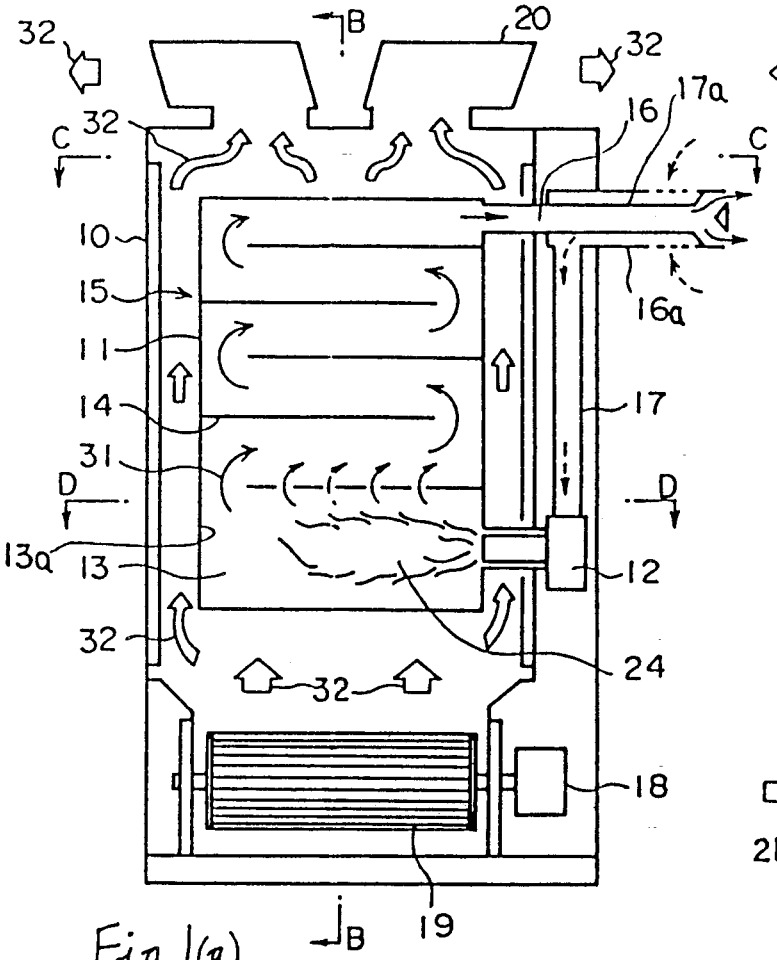
FIG. 1 illustrates an embodiment of a hot-air furnace of the present invention wherein FIG. 1(*a*) is a front view, FIG. 1(*b*) a sectional view along the line B—B of FIG. 1(*a*), FIG. 1(*c*) a sectional view along the line C—C of FIG. 1(*a*), and FIG. 1(*d*) a sectional view along the line D—D of FIG. 1(*a*)
Figure 1B:
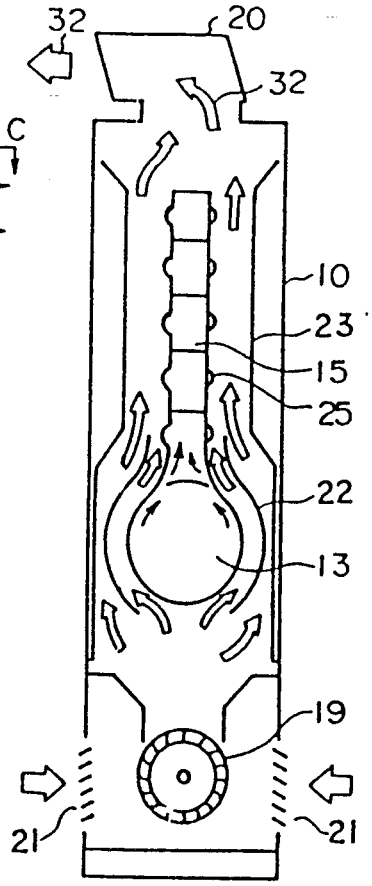
Figure 1C:
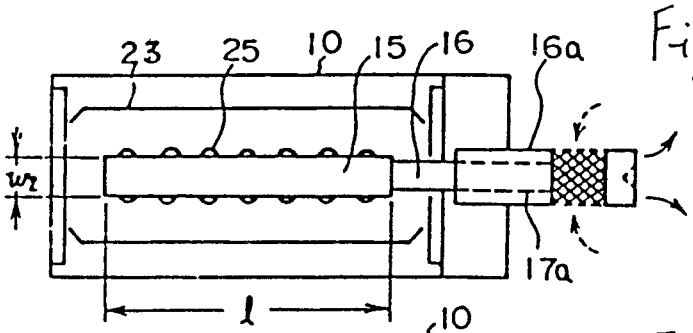
Figure 1D:
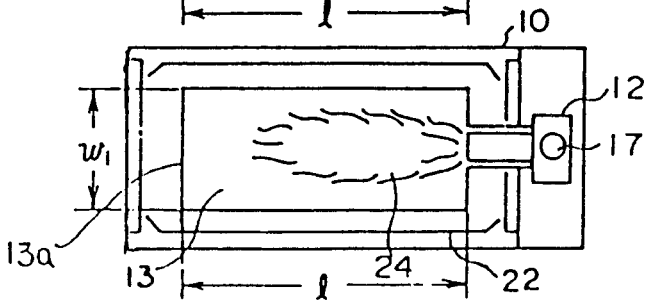
Figure 2A:
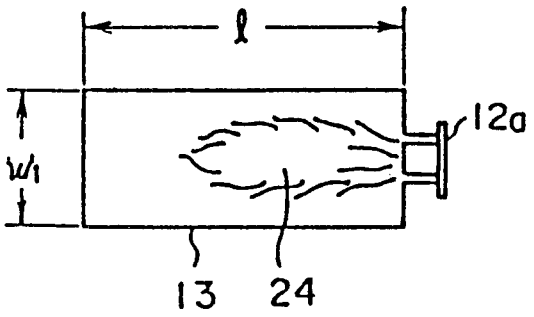
FIG. 2(*a*) to (*g*) are sectional views of various embodiments of the combustion chamber structure of the hot-air furnace of FIG. 1.
Figure 2B:
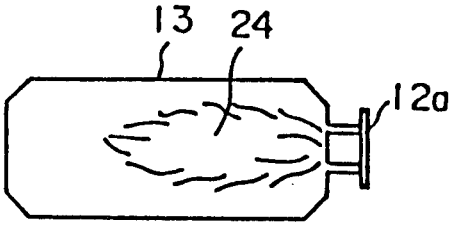
Figure 2C:
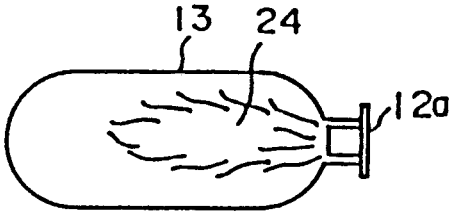
Figure 2D:
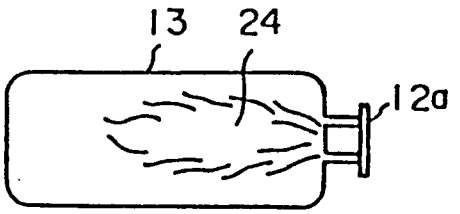
Figure 2E:
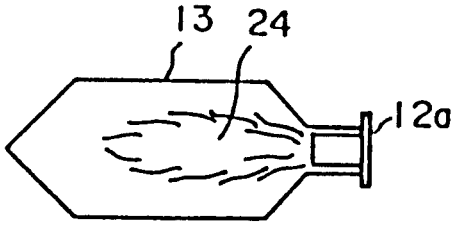
Figure 2F:
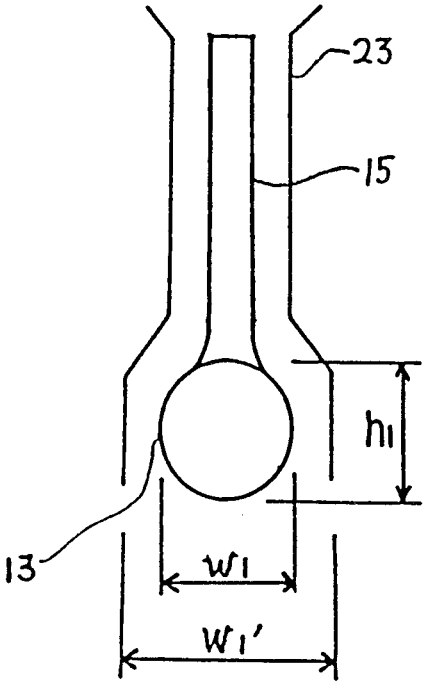
Figure 2G:
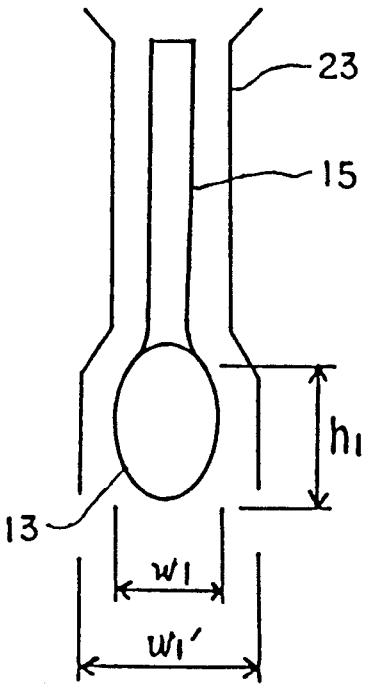
Figure 3A:
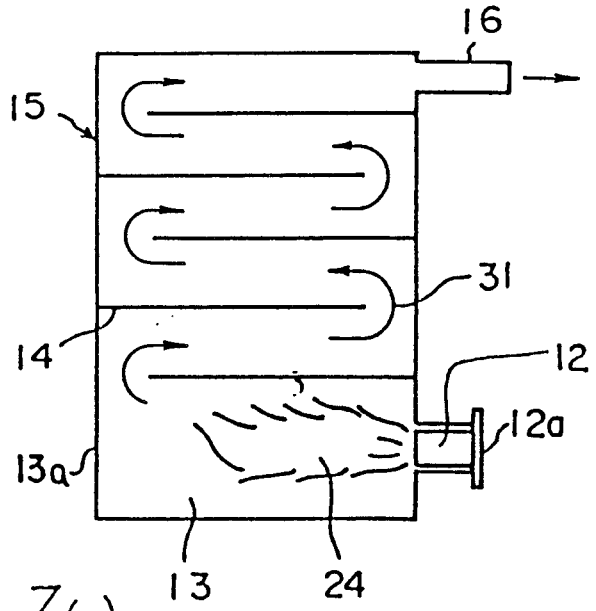
FIG. 3 illustrates a heat exchanger structure, wherein FIG. 3(*a*) is a front view, FIG. 3(*b*) a side view, FIG. 3(*c*) a front view of a variation, FIG. 3(*d*) a side view thereof, FIG. 3(*e*) a front view of another variation and FIG. 3(*f*) a side view thereof.
Figure 3B:
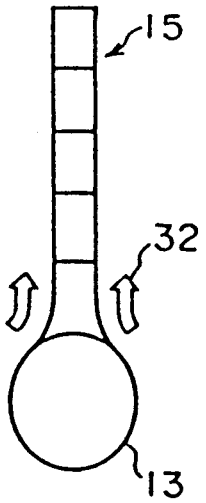
Figure 3C:
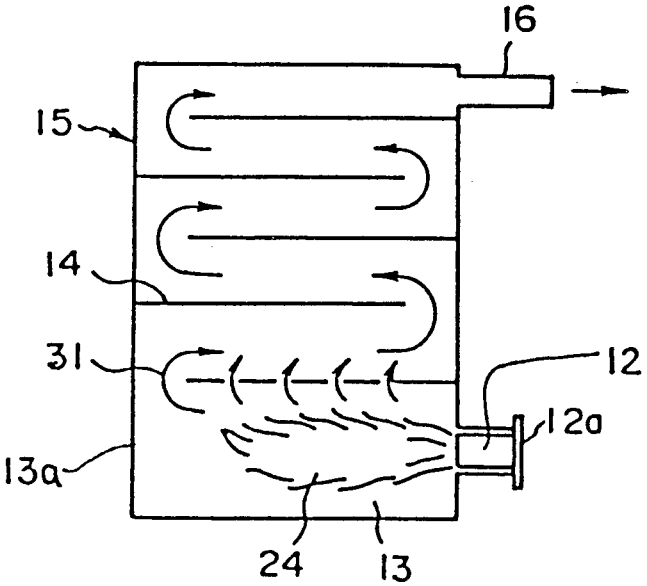
Figure 3D:
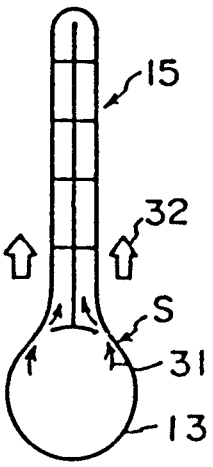
Figure 3E:
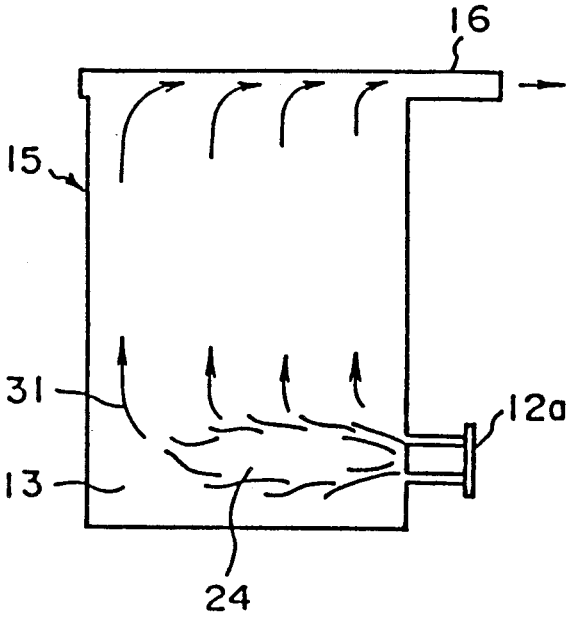
Figure 3F:
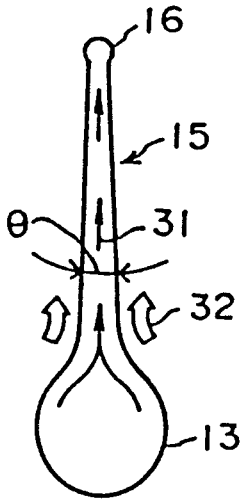

Various embodiments of the invention will now be explained in detail with reference to the drawings.

An embodiment of this invention is shown in FIG. 1, wherein FIG. 1(*a*) is a front view, FIG. 1(*b*) a sectional view along the line B—B of FIG. 1(*a*), FIG. 1(*c*) a sectional view along the line C—C of FIG. 1(*a*), and FIG. 1(*d*) a sectional view along the line D—D of FIG. 1(*a*). In FIG. 1, 10 is a casing, 11 a drum, 12 a burner, 13 a combustion chamber, 14 a gas flow guide plate, 15 a heat exchanger, 16*a* a combined air supply and exhaust duct from around the periphery of which air for combustion is supplied and led to an air supply duct 17. An exhaust port 16 is connected to an inner duct 17*a* of the air supply and exhaust duct 16*a*, and cooled combustion gas is exhausted through the inner duct 17*a* of this air supply and exhaust duct 16*a*. A fan motor 18 drivingly rotates a blower 19 to draw air in through suction ports 21 and discharge hot air through discharge port 20. This air flow passes through an air flow guide and directing plate 23 while passing over a radiant heat absorber plate 22 and projecting parts 25. The solid line arrows indicate combustion gas flow 31 from flame 24, the white arrows denote air flow 32, and the broken line arrows indicate air being taken in for combustion. Combustion gas flow 31 generated in the combustion chamber 13 flows almost uniformly in the upper part of the combustion chamber 13 and above the side portion 13*a* of the combustion chamber, and then is directed to the heat exchanger 15 by the gas flow guide plate 14, and exhausted to the outside through the exhaust port 16. The air taken in through the suction port 21 is directed by the blower 19 as air flow 32 from the lower part of the combustion chamber 13 to the upper part thereof, and after being heated by the combustion chamber 13 and the heat exchanger 15, air flow 32 is discharged from the discharge port 20.

The embodiment shown in FIG. 1 is of a structure in which:

(i) there is a long-flame type burner 12 for combusting gas or liquid fuel;

(ii) a combustion chamber 13 is small in diameter and long-bodied, and is located at the lower part of a drum 11;

(iii) a heat exchanger 15 is located above the combustion chamber 13 and is thin and flatshaped;

(iv) an exhaust part consisting of an exhaust port 16 corresponds to a thin, flat and longshaped drum structure placed above the heat exchanger 15;

(v) a blower 19 is placed below the drum 11; and (vi) hot blast or air is discharged from the position opposite to the blower location, i.e. The air is discharged from the upper part of the drum.

Referring to FIG. 1(*c*) and FIG. 1(*d*), the relation of width $w_2$ of the heat exchanger 15, which has on its surface the projecting parts 25 forming dimples or folds, and width $w_1$ of the combustion chamber 13 were selected to be $w_2 <$ or $= w_1$, and width $w_1$ of the combustion chamber was set to be $1/w_1 >$ or $= 1.5$, where 1 is the common length of the heat exchanger 15 and the combustion chamber. This design makes it possible to render a hot-air furnace according to this invention flat and thin-shaped.

The values of above-mentioned $w_1$,$w_2$ and 1 were as follows in two specific embodiments:

| Embodiment | I | II |
|---|---|---|
| $w_2$ | 70 mm | 100 mm |
| $w_1$ | 200 mm | 250 mm |
| 1 | 600 mm | 740 mm |

The heat outputs obtained in the embodiments I and II were 20,000 [kcal/h] and 32,000 [kcal/h] respectively, at 89% thermal efficiency.

In FIG. 2, the structure of the combustion chamber and various variations thereof are illustrated. The cross section shape of the combustion chamber 13 is almost round as shown in FIG. 2(*f*), or oval or elliptical as shown in FIG. 2(*g*). In FIGS. 2(*a*) to (*e*), various longitudinal sections of the combustion chamber 13 are shown. FIG. 2(*a*) illustrates a basic shape, that is, a rectangular shape of the combustion chamber 13, wherein 12*a* is a burner port. Other illustrations in FIGS. 2(*b*), (*c*) and (*d*) are variations of the combustion chamber 13 in FIG. 2(*a*), wherein its corners are notched or rounded, to provide a somewhat elliptical shape. In the variation shown in FIG. 2(*e*), both ends of the combustion chamber 13 are tapered. From the viewpoint of keeping uniform heat transfer and relieving local heat stress, it is desirable to have the corners rounded, such rounded corners enabling easy manufacture with press metal molds.

With the above structure of the combustion chamber 13, uniform heating can be attained with less heat stress and less damage due to heat fatigue Selection of material for a combustion chamber may be done freely, taking into consideration combustion chamber load, the surface temperature of the combustion chamber, and economy. The air flow can be directed at right angles to the combustion chamber and circulated at high speed, and owing to good cooling conditions, without use of high-grade thermal resisting steel, thus making a design fit for practical use possible As shown in FIG. 2(*f*) and FIG. 2(*g*), the combustion chamber 13 has an almost circular section with its height $h_1$ being equal to its width $w_1$ (i.e. $h_1 = w_1$). But it can be also arranged so that $h_1 > w_1$, in which case the combustion chamber 13 has an elliptical section with width $w_1$ of the combustion chamber being narrowed, and therefore width $w_1'$ of the air flow guide and directing plates 23 at the combustion chamber shown in these figures can be also narrowed, and a more compact design is realized.

Figure 4A:
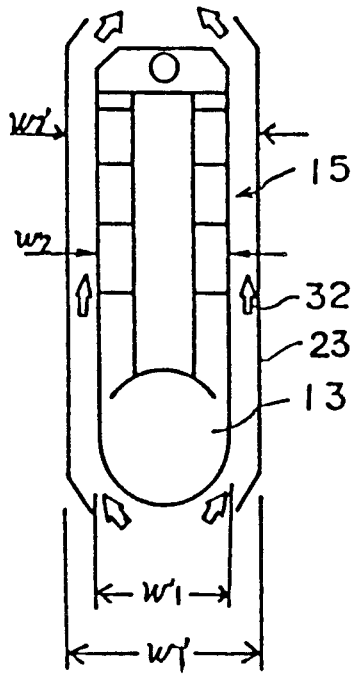
FIGS. 4(*a*) to (*c*) are side sectional views of different drum embodiments for the hot-air furnace of FIG. 1.
Figure 4B:
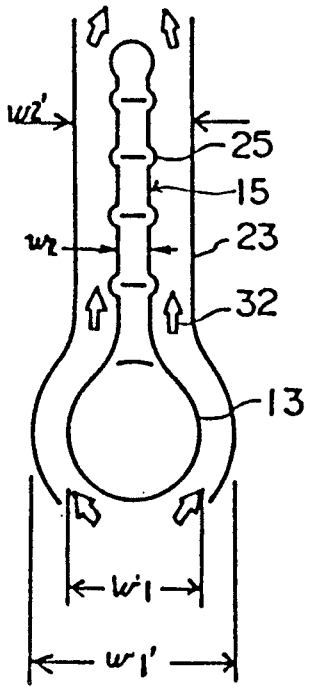
Figure 4C:
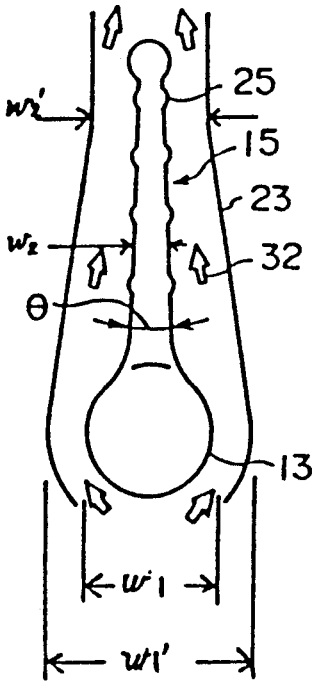
Figure 5A:
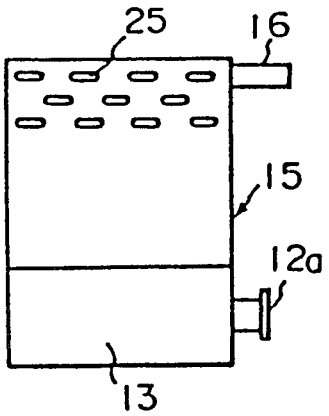
FIGS. 5(*a*) to (*j*) are views illustrating various embodiments of projecting parts on the sides of the heat exchanger.
Figure 5B:
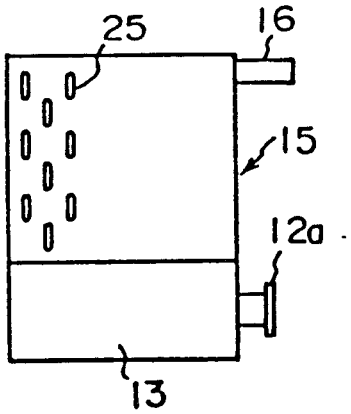
Figure 5C:
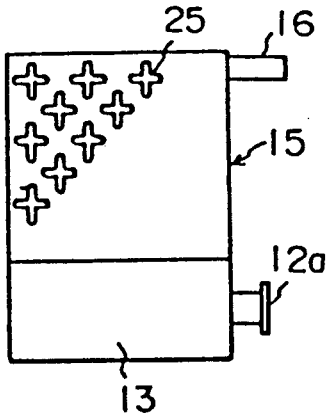
Figure 5D:
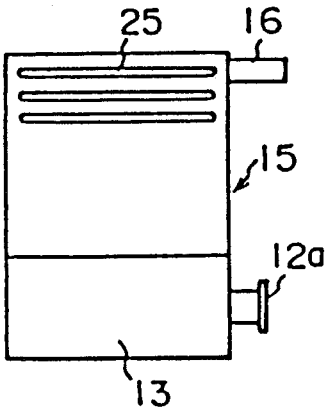
Figure 5E:
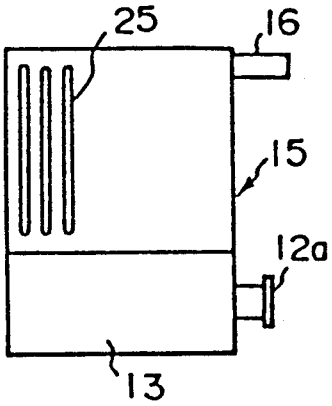
Figure 5F:
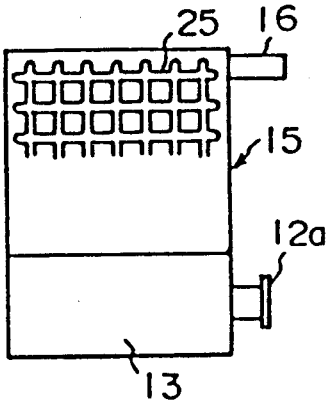
Figure 5G:
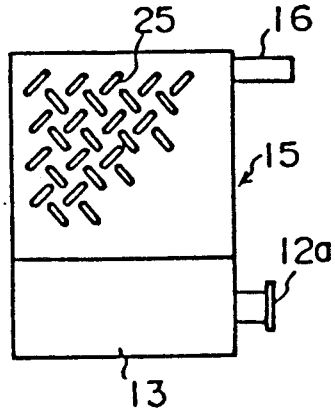
Figure 5H:
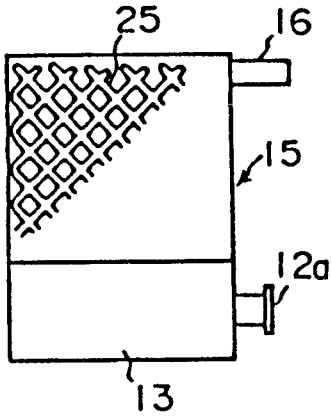
Figure 5I:
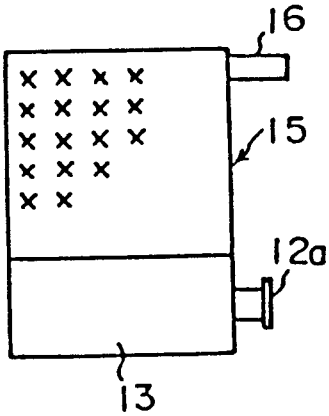
Figure 5J:
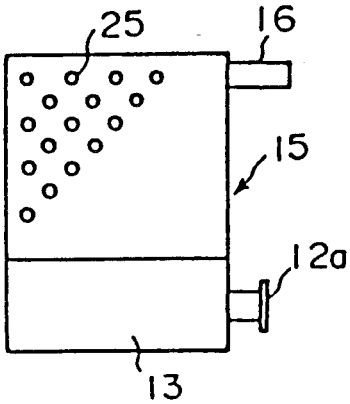
Figure 6A:
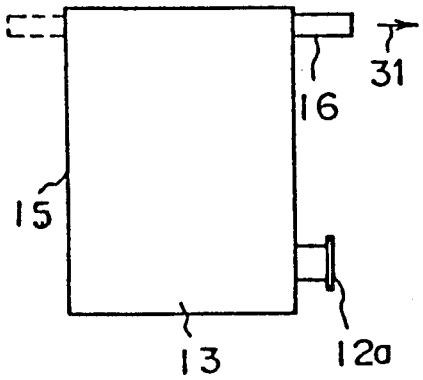
FIG. 6 shows different arrangements for the exhaust port, wherein FIG. 6(*a*) is a front view of setting up thereof on the front or rear side of the heat exchanger, FIG. 6(*b*) a front view of setting up thereof on the lateral side of the heat exchanger, FIG. 6(*c*) a side view of the embodiment in FIG. 6(*b*), FIG. 6(*d*) is a front view of setting the same upon the top of the heat exchanger and FIG. 6(*e*) is a side view of the embodiment in FIG. 6(*d*)
Figure 6B:
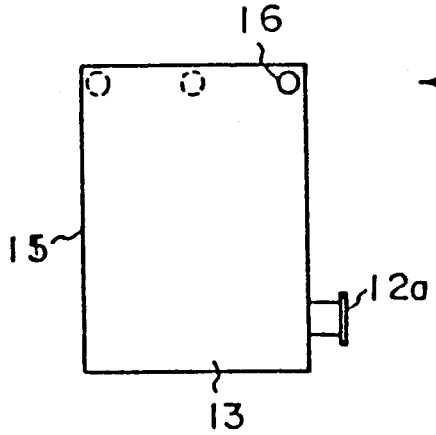
Figure 6C:
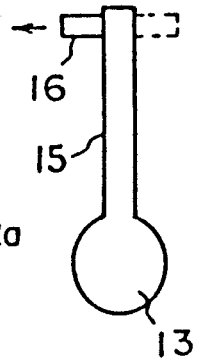
Figure 6D:
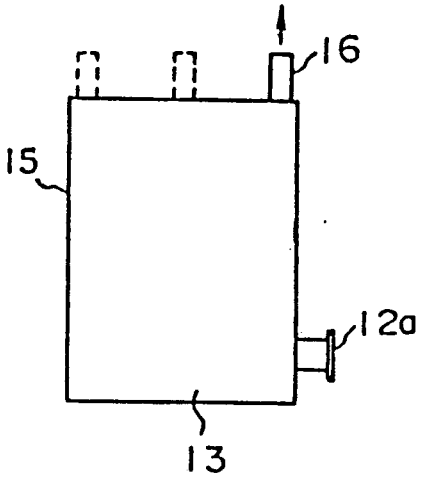
Figure 6E:
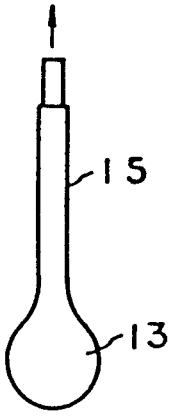

Various embodiments of the heat exchanger 15 for attaining effective heat transfer will now be described in greater detail referring to FIGS. 3, 4 and 5. FIG. 3 illustrates the structure of a heat exchanger, wherein FIG. 3(*a*) is a front view, and FIG. 3(*b*) a side view; FIGS. 3(*c*) and (*e*) are front views of variations, and FIGS. 3(*d*) and (*f*) side views of these variations. FIGS. 4(*a*), (*b*) and (*c*) are respective side views of different drums in vertical section, each showing a different construction. FIGS. 5(*a*) to (*j*) are illustrations of various patterns of dimples or folds formed on the sides of the heat exchanger 15.

Width $w_2$ of the heat exchanger 15 may be selected, as shown in FIGS. 4(*a*), (*b*) and (*c*), relative to the width $w_1$ of the combustion chamber 13, interval space width $w_1''$ of the air flow guide and directing plate 23 at the combustion chamber part, and width $w_2'$ of the said air flow guide and directing plate 23 at the heat exchanger part, so that generally $w_1 < w_1'$, $w_2 < w_2'$, $w_2 <$ or $w_1$, $w_2' <$ or $= w_1'$; in the embodiment shown in FIG. 4(*a*) $w_2 = w_1$; in FIG. 4(*b*) embodiment $w_2 < w_1$; and in the tapered embodiment shown in FIG. 4(*c*), both $w_2$ and $w_2'$ become narrower approaching the exhaust part, and even if the combustion gas is cooled and its volume is reduced, heat exchange is effected at an angle $\theta$ enabling the gas to flow at substantially constant speed so as to keep effective heat transfer.

Specific values of examples of the above-mentioned $w_1$,$w_2$, $w_1'$, $w_2'$ are given in the following table:

| Embodiments | I | II |
|---|---|---|
| $w_1$ | 200 mm | 250 mm |
| $w_2$ | 70 mm | 100 mm |
| $w_1'$ | 340 mm | 410 mm |
| $w_2'$ | 200 mm | 280 mm |

The heat outputs obtained in these embodiments I and II were 20,000 [kcal/h] and 32,000 [kcal/h] respectively, at 89% thermal efficiency.

As FIG. 3(*a*) illustrates, the edge 13*a* of the combustion chamber which faces the burner is located in the position most easily affected by the flames and vulnerable to damage by burning. Accordingly, as shown in the side view of the variation of FIGS. 3(*c*) and (*d*), the part marked with a reference S is of a structure which disperses the flames along the side walls of the combustion chamber and directs them to the heat exchanger, so as to obtain uniform heat transfer effect, prevent local overheating and reduce the possibility of the thermal stress being generated. The variation shown in FIGS. 3(*e*) and (*f*) is similar to that shown in FIG. 4(*c*).

FIGS. 5(*a*) to (*j*) show shapes and arrangements of the projecting parts 25 on the surface of the heat exchanger 15. Basic shapes are shown in FIGS. 5(*a*), (*d*), (*g*) and (*j*), and variations of the first three thereof are shown respectively in FIGS. 5(*b*) and (*c*), FIGS. 5(*e*) and (*f*), FIGS. 5(*h*) and (*i*). These projecting parts 25 cause turbulent flows when combustion gas and air flow, respectively, are passing over the wall surface of the heat exchanger 15 and enhance heat transfer. In particular, they play an important role in removing boundary layers in a flat-plate heat exchanger as employed in this invention. Each variation shows a specific result of a specific manufacturing process The projecting parts 25, which are shown as lines of ridges, or crosses, or diamonds, or pips etc. are preferably distributed in a pattern over the entire side walls of the heat exchanger 15 above the combustion chamber 13.

The exhaust part consisting of the exhaust port 16 is shown in FIG. 6, wherein FIG. 6(*a*) is a front view illustrating a set-up on the upper front or rear side, FIG. 6(*b*) is a front view illustrating a set-up on the upper right or left-hand side, FIG. 6(*c*) is a side view of the embodiment of FIG. 6(*b*), FIG. 6(*d*) is a front view illustrating a set-up on the top side, FIG. 6(*e*) is a side view of the embodiment of FIG. 6(*d*), and the solid line arrow shows exhaust gas flow. The exhaust port 16 is located at the position indicated by the solid line, but it may also be mounted at the position indicated by the broken line. As shown in the illustrations, the exhaust port 16 can be placed as desired, in the front or rear side, right or left-hand side, or on the top side. Air supply and gas exhaust by FF (Forced Flue) system can be also done as shown in the front view of FIG. 1(*a*). As the exhaust port can be set up on the top side or at any of the upper four positions, there is less crosscut for connection to an exhaust chimney at the time of installation of a hot-air furnace, allowing easier installation.

Figures 7A, 7B, 7C:
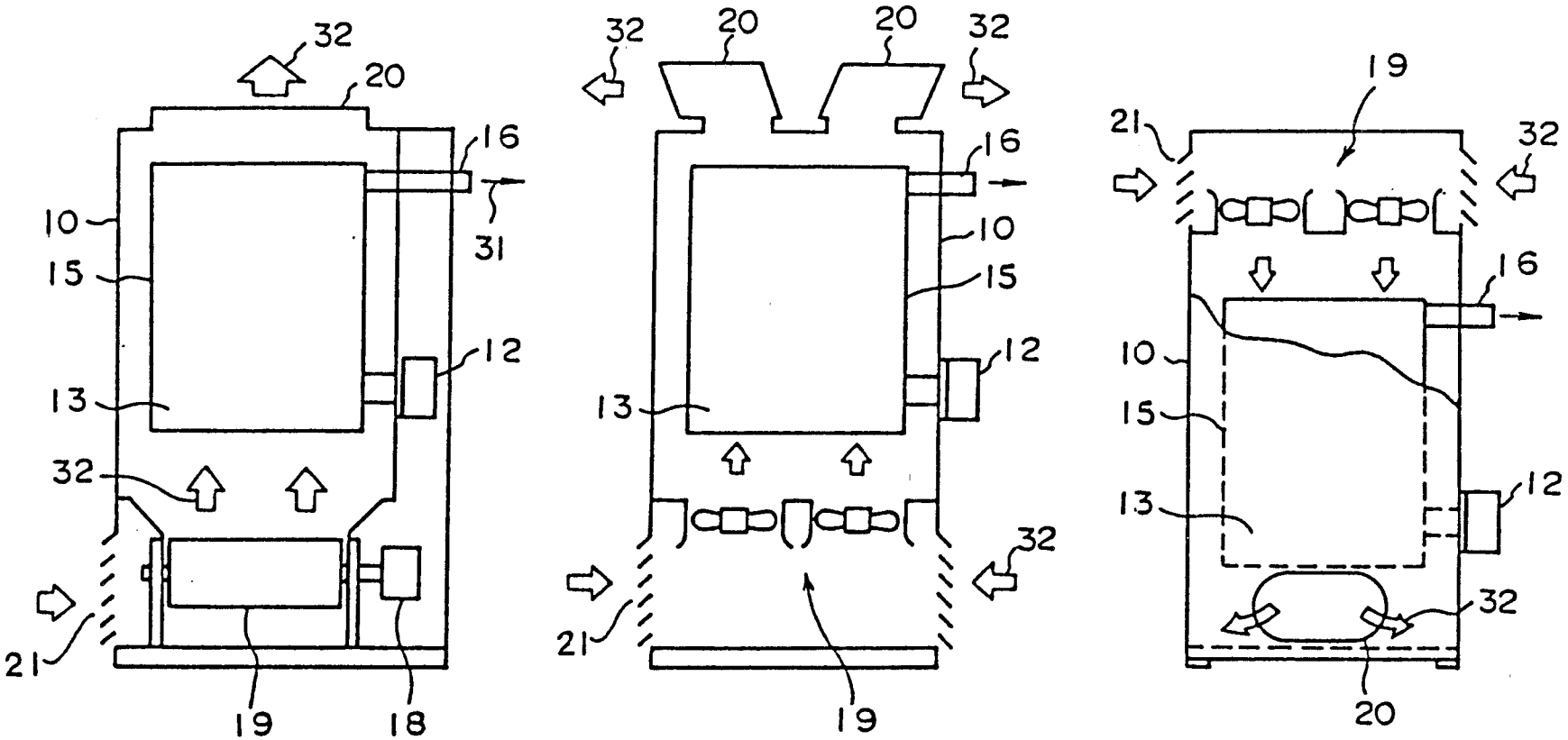
FIGS. 7 (*a*) to (*c*) are front views of three hot-air furnaces of the present invention showing different arrangements of the blower and the discharge port.
Figure 9C:
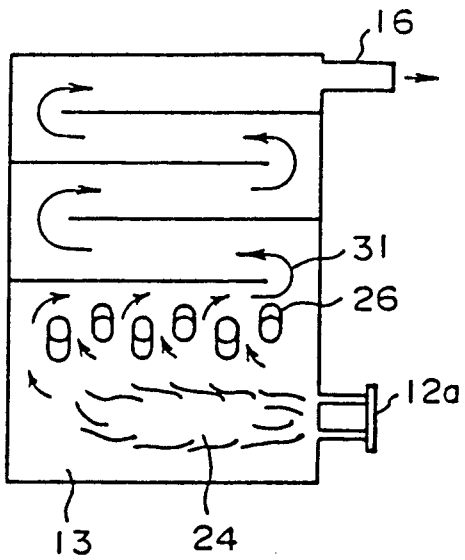
FIG. 9 shows a ventilation and heat transfer pipe arrangement wherein FIG. 9(*a*) is a side view, FIG. 9(*b*) a front view, FIG. 9(*c*) a front view showing combustion gas flow, and FIG. 9(*d*) a top view.
Figure 9F:
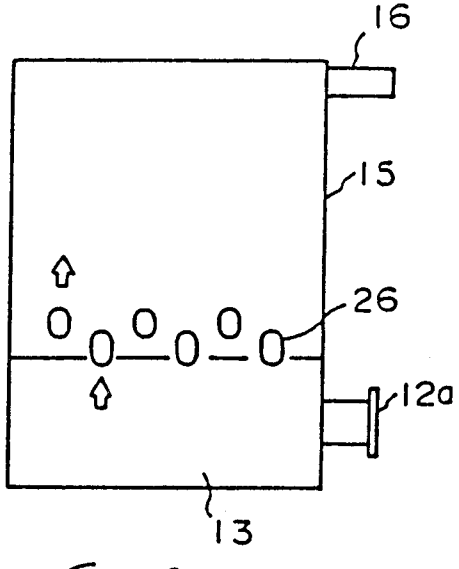
Figure 9D:
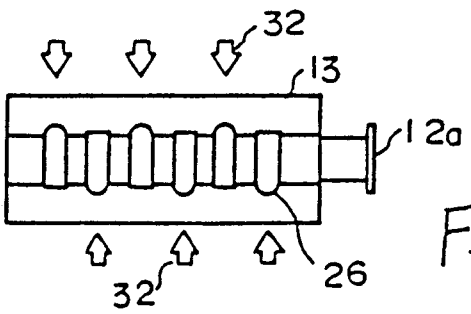
Figure 9A:
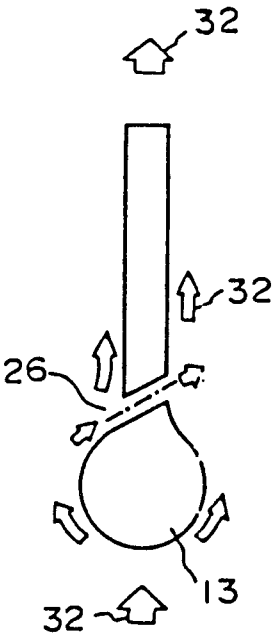
Figure 10A:
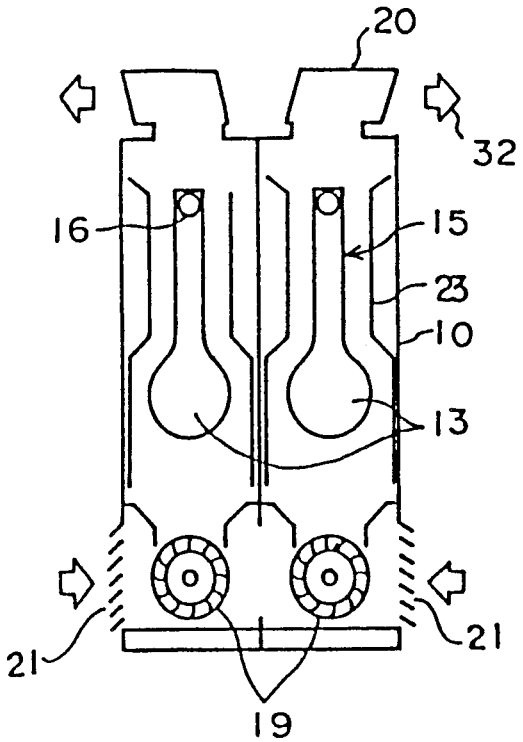
FIG. 10 shows multiple unit furnaces in which two or more hot-air furnaces are connected together, FIG. 10(*a*) being a front sectional view of a twin connection embodiment, FIG. 10(*b*) a front view of the twin connection embodiment, FIG. 10(*c*) a top view of the twin connection embodiment, FIG. 10(*d*) a top view of a triple connection embodiment, and FIG. 10(*e*) a top view of a quadruple connection embodiment.
Figure 10B:
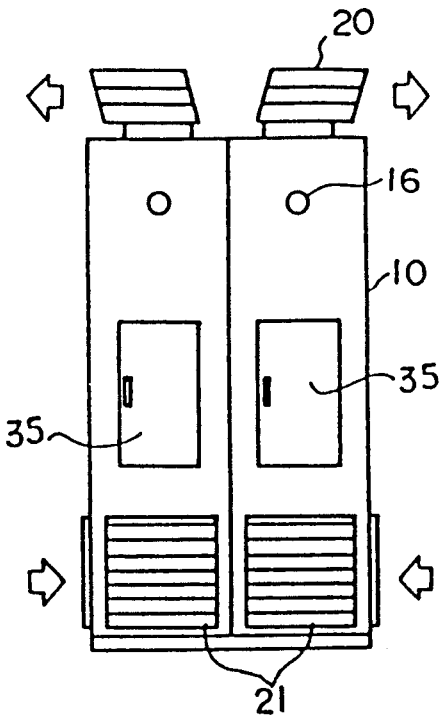

Arrangements according to the invention of a blower, an air suction port and an air discharge port are shown in FIG. 7, wherein FIGS. 7(*a*), (*b*) and (*c*) are front views of respective variations. The blower 19 can take the form of crossflow, duplex sirocco fan system, or of a plurality of propellers. The suction port 21 is mounted at the upper or lower part adjacent where the blower 19 is placed, and the discharge port 20 is located at the lower or upper part opposite to the position where the blower 19 is located. The heat-exchanged air flow discharges from the discharge port 20 as hot air or blast. Where inexpensive sirocco fans are used side by side, the air can be distributed uniformly and there is an advantage of having less height than in the case of a single fan. A forced ventilation system is applied against and over the heat exchanger 15, and it can be an upwardly discharging or downwardly discharging type depending on the end use. Air can flow evenly, ventilation resistance and ventilation power can be reduced, and a large amount of wind or air flow can be obtained with low noise.

The casing or outer covering 10 is flat, long and rectangular-shaped, and by rounding the corners thereof, a simple and attractive design is obtained.

As described above, the position of the blower and that of the discharge port depend on each other, and manufacturing of products of either upwardly discharging or downwardly discharging type according to the need is possible. Also, a duct connect type can advantageously be provided by having a flange-typed exhaust part.

Figure 8:
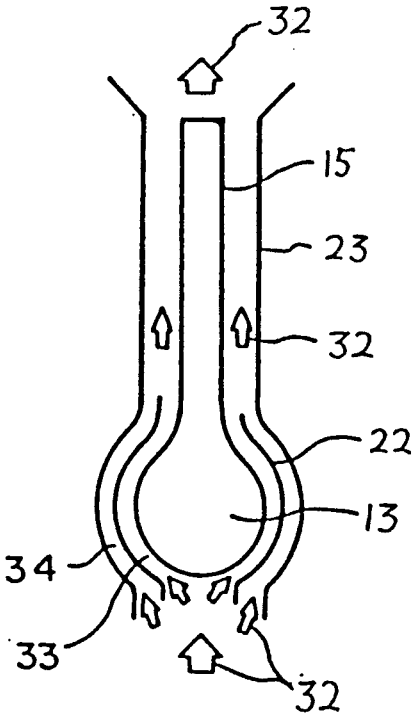
FIG. 8 is a side sectional view of the periphery of the drum.

FIG. 8 is a drawing to explain an embodiment for utilizing radiant heat transfer around the combustion chamber. The combustion chamber 13 is kept at the highest temperature condition in the heat exchanger 15 and is capable of positive heat transfer. In selecting material for the combustion chamber, it is desirable to reduce temperature as low as possible and accelerate heat transfer. Therefore, by painting black-colored radiation accelerator agent on the surface of the combustion chamber 13, and also by applying paints which easily absorb radiant heat to radiant heat absorber plate 22 opposite and partly surrounding the combustion chamber, radiant heat is absorbed; and further, by transferring heat to air by way of convection effect, more radiation of heat can be realized in the combustion chamber. The air flow 32 directed by the radiant heat absorber plate 22 is separated into the outside air way 34 and the inside air way 33. With this arrangement, when the amount of heat transfer in the combustion chamber 13 is large, the burden to the heat exchanger will be reduced, and thus the size of the heat exchange can be made smaller and the whole structure more compact.

Methods using ventilation and heat transfer pipes to mix air flows, accelerate heat transfer and prevent damage by burning are illustrated in FIG. 9, wherein FIG. 9(*a*) is a side view, FIG. 9(*b*) a front view, FIG. 9(*c*) a front view showing the combustion gas flow 31 indicated by the solid line arrows, and FIG. 9(*d*) a plan view. As shown in FIGS. 9(*a*) to (*d*), the ventilation and heat transfer pipes 26 are disposed obliquely and upwardly of the combustion chamber 13 and alternately pass through the heat exchanger 15, being directed from right to the upper left, or from left to the upper right as in FIG. 9(*a*). As the combustion gas flow is directed at right angles to the external periphery of the ventilation and heat transfer pipes 26 as shown in FIG. 9(*c*), good heat transfer is obtained from the hot combustion gas. Also, if a suitable number of the ventilation and heat transfer pipes are mounted, the combustion has can be directed uniformly to the heat exchanger. On the other hand, part of the air flow 32 having passed along the combustion chamber 13 goes through the ventilation and heat transfer pipe 26 as shown in FIG. 9(*a*) and comes out of the opposite side to be mixed together with the air flow there, and then flows toward the heat exchanger 15. In this way, mixing of air takes place in the heat exchanger, and heat transfer is improved by contacting with air flow having a temperature made uniform by this mixing. The upper part of the combustion chamber is easily affected by the high temperature combustion gas flow, but forced air cooling is possible and thus there is no need to use high temperature thermal resisting materials to prevent burning.

Embodiments employing a single hot-air furnace according to this invention have been explained above. Because of its flat and longitudinally long structure, however, this hot-air furnace can be used to provide multiple unit furnaces by connecting two or more of them. FIG. 10 shows some examples employing a connection system, wherein FIG. 10(*a*) is a front sectional view of an embodiment of connecting two furnaces, and FIG. 10(*b*) a front view of the embodiment of connecting two furnace. As the illustrated hot-air furnaces are flat and long-shaped, in the examples employing this connection system, a multi-stage control can be realized with ON/OFF control of the burner. For example, when two furnaces are connected together as shown in FIGS. 10(*a*) and (*b*), high and low burners can be mounted respectively, at low fire of 70% for one of the burners, fire control of 100%, 85%, 70%, 50%, 35%, 0% which approximates to proportional control, can be obtained. In FIG. 10(*b*), an inspection door 35 is provided in each unit and can be opened and closed for inspection and the like.

In employing two hot-air furnaces, such modes as shown in the left column of the table below are possible, the center column giving the percentage output relative to a single hot-air furnace, and the right column giving the percentage output of the multiple unit as a whole:

| | | |
|---|---|---|
| Both high | 200 | 100% |
| High/Low | 170 | 85% |
| Both low | 140 | 70% |
| One OFF, the other high | 100 | 50% |
| One OFF, the other low | 70 | 35% |
| Both OFF | 0 | 0% |

an output control range in twin connection high/low system can be generalized as shown below.

In an embodiment of the twin connection system, when high output of one of the two is 100% and low output is a%, and the two hot-air furnaces are designated as No.1 furnace and No. 2 furnace, respectively, overall output can be in the range of 200% to 0%. Output of the hotair furnaces in the embodiment of the twin connection system will be as follows:

(i) Table of output:

| | high | low | OFF |
|---|---|---|---|
| No. 1 furnace | 100 | a | 0 |
| No. 2 furnace | 100 | a | 0 |

(ii) Combination of output:

The following percentages can be obtained from a combination of output of furnaces No.1 and No.2 above:

200, 100 + *a*, 100, *a*, *a*, 0

(iii) Combination of output, when integrated high output of twin connection is 100%, is as follows:

100, 50 + *a*/2, *a*, 50, *a*/2, 0

The values of this combination are half of those in the combination in (ii) above.

Figure 11:
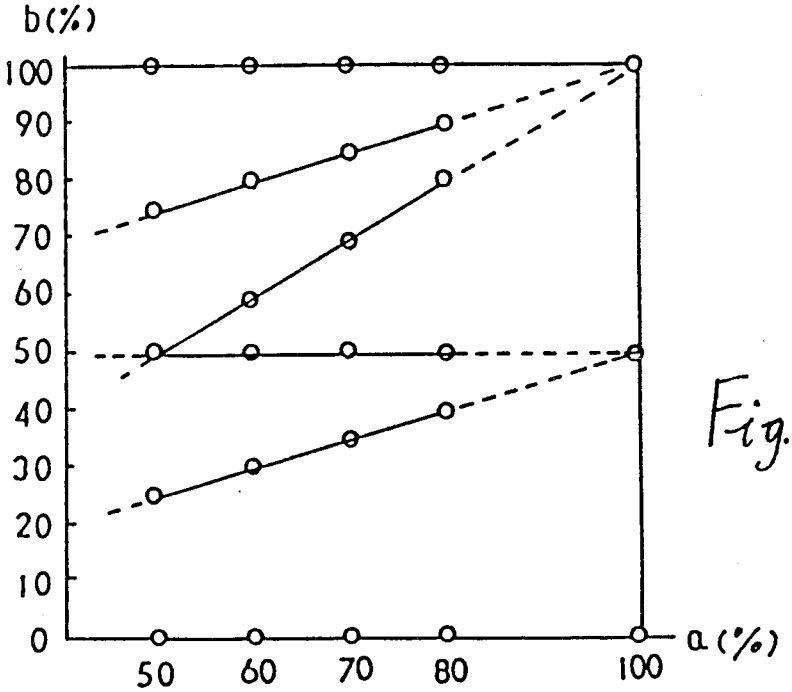
FIG. 11 is a chart showing an example of the output control range of the twin connection embodiment of FIGS. 10(*a*) to (*c*)
Figure 10C:
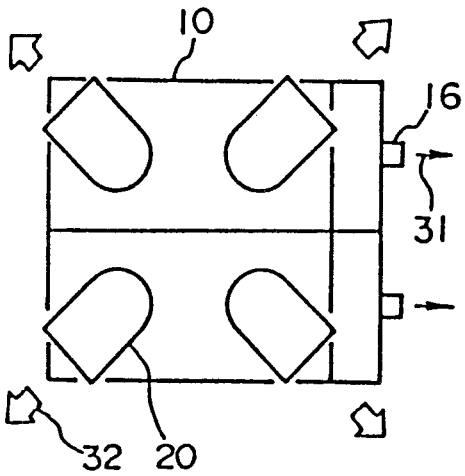
Figure 10D:
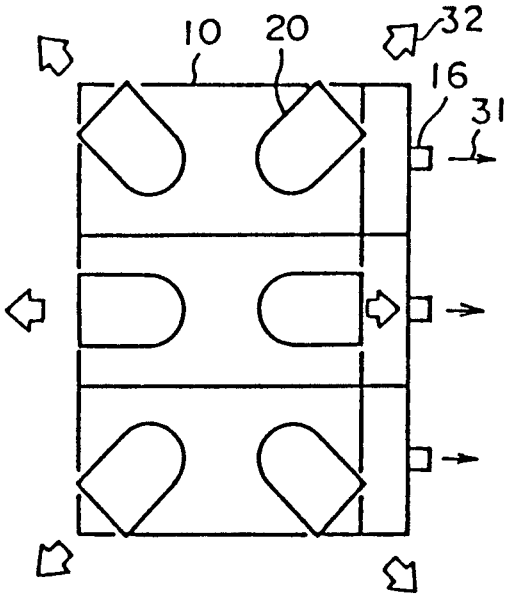
Figure 10E:
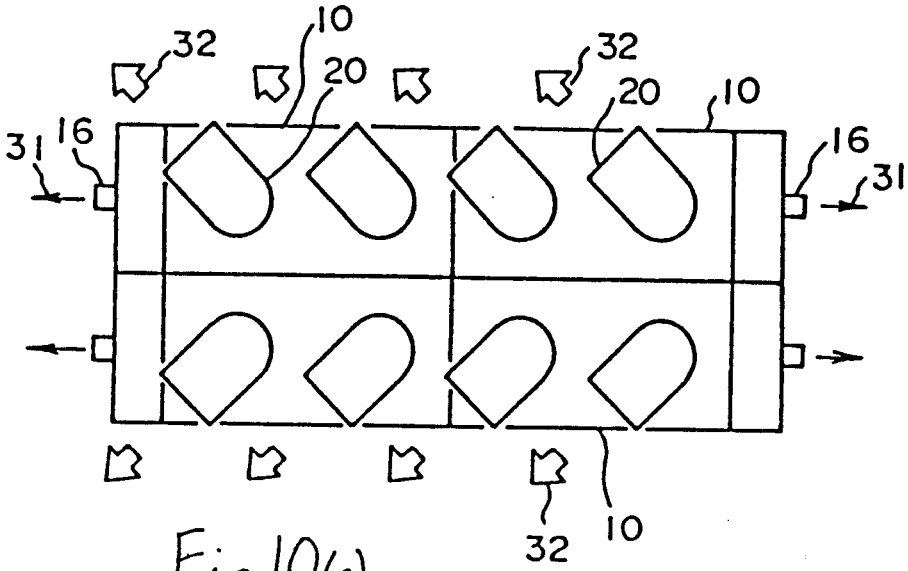

In the case of twin connection, as shown in a chart of FIG. 11, with combination of a high/low control, wide control range can be obtained. In FIG. 11, on the abscissa axis, low output a(%) of one of the two furnaces is shown with high output of the other being 100%, and on the ordinate axis, overall output of two furnaces connected is shown by b(%). However, proper oil amount, that is, low oil amount which in general is highly practical, is 50% to 80%, and is 100% when high, as indicated by the solid line in the chart of FIG. 11. Namely, at 50% low oil amount (on the abscissa axis), five stage control of 100%, 75%, 50%, 25% and 0% shown on the ordinate axis can be obtained, and at 80% low oil amount (on the abscissa axis) six stage control of 100%, 90%, 80%, 50%, 40% and 0% When low oil amount is 60% or 70% (on the abscissa axis), six stage control shown in FIG. 11 is applicable to each case. By selecting the proper oil amount of the high/-low-type burners, the output control range as shown in FIG. 11 can be obtained and a multi-stage control almost like a proportional control can be easily realized.

Where three or more furnaces are connected, high/-low combinations as control output model become complicated, and it is more useful to perform ON/OFF control of each hot-air furnace than to seek the practicality of a multi-stage control For example, if overall output is 100% in triple connection, with two ON, output will be 67%, and with one ON 33%.

Similarly, with ON/OFF control of each hot-air furnace, in an embodiment of four furnaces connected, output of 100%, 75%, 50% and 25% can be obtained when overall output is 100%, and output close to the proportional control can be obtained almost all over the range.

FIG. 10(*c*) is a top view of an embodiment of twin triple connection, and FIG. 10(*e*) a top view of an embodiment of quadruple connection, the white arrows indicating the discharged air flow 32.

Figure 12A:
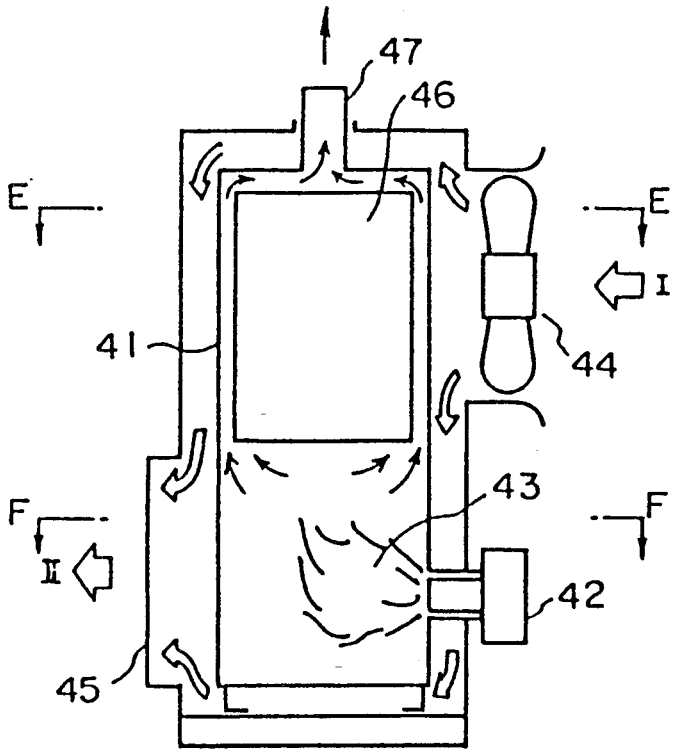
FIG. 12 shows prior art furnaces, wherein FIG. 12(*a*) is a front sectional view of the furnace and duct unified type, FIGS. 12(*b*) and (*c*) front sectional views of the furnace, duct and smoke tube type, FIG. 12(*d*) a front sectional view of the furnace, duct and heat exchanger type, FIG. 12(*e*) a sectional view along the line E—E of FIG. 12(*a*), and FIG. 12(*f*) a sectional view along the line F—F of FIG. 12(*a*).
Figure 12B:
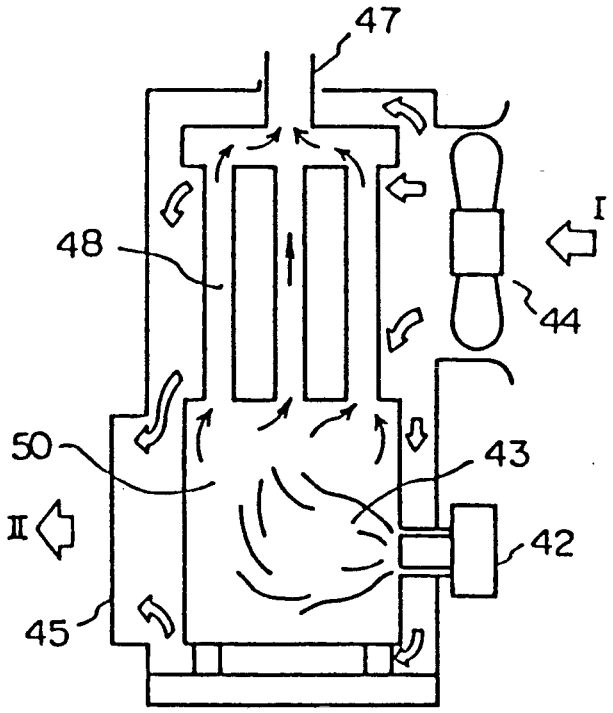

The inventors carried out a test on the embodiment shown in FIG. 12(*a*), load of the combustion chamber (furnace load) [kcal/hm$^3$] was improved by about 105%, and heat transfer load in the combustion chamber 13 (surface load) [kcal/hm$^2$] was also improved by about 45%, and the overall heat transfer load [kcal/hm$^2$] including the heat exchanger 15 was improved by about 20%. Especially, the heat transfer performance in the combustion chamber part was remarkable improved.

The amount of air was considerably increased, up about 25% up. Also, the amount of air and temperature of the discharged air at each discharge port were made uniform, so that they contributed very much to the hot air circulation effect.

The noise level was reduced by about 5db. Where cross flow fans are employed, further noise reduction can be attained.

As the hot-air furnace was made thin, its width was reduced to almost half compared to the conventional type In our estimate of cost, after taking into full consideration of above factors, it could be certainly reduced by about 15 to 20% compared to the conventional type.

Improvements in performance, reduction in size, standardization and cost reduction effects, all taken together, are presumed to contribute to achieve a considerably economical effect.

This invention makes it easy in the manufacture of hot-air furnace to employ press processing, automatic welding, standardized production and robots, and offers a great advantage in the manufacturing process, and the space to install and store products is reduced, resulting in easier maintenance and management.

The invention also makes it possible to employ FF systems and connection systems requiring less installation space than the conventional product, and easier moving is possible, so that advantages in practical use are substantial.

Accordingly various embodiments of this invention enable the following effects to be obtained:

(1) With long flames, use of gun-type burners becomes easy and flame adjustment at wide range TDR (Turndown Radio) also becomes easy.

(2) When the drum is of the thin-type press structure, it is easy to form it in a small compact size. Processing is also easy and automatic processing is possible. Further, it can take the upright structure with small installation space, so as to be convenient for delivery.

(3) It can easily reduce ventilation resistance and obtain a large amount of air with low level noise (both heat blast and burner).

(4) The exhaust part can be at the right or left-hand side, or in the front or rear side of the furnace, so that the FF system can be easily applied.

(5) As a blower, plural number of small propeller fans or cross flow fans can be employed, so that a large amount of air can be obtained at low noise.

(6) Connection can be easily effected, and a large output can be realized.

(7) It is easy to change the up or down position of the discharge port of the blower so as to make it easily an upwardly discharging or downwardly discharging type.

(8) Because of the above, a considerable cost reduction is possible, and comparing with the conventional furnace, a cost reduction of about 15 to 20% can be realized.

(9) Heat resisting steel can be used in the combustion chamber part, and it is easy to make use of radiation heat transfer providing the further possibility of making its size smaller.

It will be appreciated that any of the various embodiments illustrated in FIGS. 1 to 10 may be combined together in all possible combinations, for example any of the combustion chamber embodiments of FIG. 2 can be used with any of the arrangements of FIGS. 1 and 7, and any of the heat exchanger details of any of FIGS. 3, 4, 5, 8 and 9 can be employed in any of these combinations.

The above described embodiments, of course, are not to be construed as limiting the breadth of the present invention. Modifications, and other alternative constructions, will be apparent which are within the spirit and scope of the invention as defined in the appended claims.

What is claimed is:

1. A hot-air furnace, comprising:

a casing having an upper end and a lower end opposite said upper end;

a drum disposed within said casing and defining a combustion chamber and a heat exchanger;

a long-flame burner for combusting a fuel in said combustion chamber;

said combustion chamber having a length (1) and width ($w_1$) in the relationship of $w_1 < 1$;

said heat exchanger being located above said combustion chamber and having a gas flow guide plate for guiding combustion gas flow discharged from the combustion chamber to said heat exchanger;

said heat exchanger having a width ($w_2$) and length (1) in the relationship of $w_2 < 1$; and said heat exchanger being provided with an exhaust port located above said combustion chamber for exhausting the combustion gas flow therefrom; an air flow guide and directing plate covering said drum;

a radiant heat absorber plate disposed between said combustion chamber and said casing;

a blower in the casing spaced from the drum;

a discharge port for discharging heated air from the furnace; and said blower and said discharge port being disposed at opposite ends of said casing whereby hot air is discharged from said casing at an opposite end to said blower.

2. The hot-air furnace of claim 1, wherein a transverse cross-section of said combustion chamber is substantially circular and a longitudinal section thereof is generally rectangular with cut off corners.

3. The hot-air furnace of claim 1, wherein a ventilation and heat transfer pipe, for conducting the air flow to be heated substantially uniformly, extends across said drum.

4. The hot-air furnace of claim 1, wherein a combustion gas exhaust port is located on a top of said drum.

5. The hot-air furnace of claim 1, wherein a combustion gas exhaust port is located on a side of said drum adjacent a top thereof.

6. The hot-air furnace of claim 1, wherein a discharge port is above said drum and said blower is mounted below said drum.

7. An assembly comprising two or more hot-air furnaces as claimed in claim 1, connected in parallel.

8. An assembly of claim 7, further including means for independently controlling each hot-air furnace.

9. An assembly of claim 7, wherein there are only two hot-air furnaces connected in parallel, said assembly comprising means for selectively setting both of them for high combustion, one of them high and the other low, both low, one of them OFF and the other high, one of the OFF and the other low, or both OFF, whereby an overall output of 100%, 90–75%, 80–50%, 40–25%, or 0% respectively is attained so as to effect a multistage output control.

10. A hot-air furnace, comprising:

a casing having a top and a bottom, and containing an elongated combustion chamber below and connected to a heat exchanger;

a long-flame burner connected to said combustion chamber to propagate a flame in an axial direction inside and along said combustion chamber, said axial direction being horizontal;

said combustion chamber having a length in said axial direction which is greater than both the height of said combustion chamber in a vertical direction and the width of said combustion chamber in a horizontal direction at right-angles to said axial direction;

an exhaust port located above said combustion chamber adjacent the top of said casing and connected to said heat exchanger for exhausting combustion gas from said combustion chamber;

an air intake port and an air discharge port for air to be heated by said heat exchanger;

a blower connected between said air intake and discharge ports for creating an air flow ar right-angles to said axial direction and generally in a vertical direction, said blower being mounted in said casing adjacent said air intake port;

an air flow guide plate disposed between said casing and said combustion chamber and between said casing and said heat exchanger;

a radiant heat absorber plate disposed between said combustion chamber and said air flow guide plate with said air flow passing on opposite sides of said radiant heat absorber plate; and said heat exchanger having a length in said axial direction greater than a width in said horizontal direction at right-angles to said axial direction.

11. The hot-air furnace of claim 10, wherein said heat exchanger extends in a vertical direction away from said combustion chamber, and said width of said heat exchanger decreases as said heat exchanger extends away from said combustion chamber.

12. The hot-air furnace of claim 10, wherein said blower is located in said air flow between said air intake port and said combustion chamber.

13. The hot-air furnace of claim 12, wherein said combustion gas exhaust port passes inside and through an air supply duct supplying air to said burner.

14. The hot-air furnace of claim 10, wherein said heat exchanger has a series of projecting parts in a pattern on a wall thereof separating said air flow and flow of said combustion gas, said projecting parts causing turbulence in said air flow and said combustion gas flow.

15. The hot-air furnace of claim 10, wherein said air discharge port comprises at least two discharge vents on said casing top.

16. The hot-air furnace of claim 15, wherein said air intake port comprises two air inlets in opposite sides of said casing adjacent said bottom thereof.

17. The hot-air furnace of claim 16, wherein said blower rotates about an axis parallel to and below said axial direction, and said blower is disposed between said two air inlets.

18. The hot-air furnace of claim 10, wherein said lengths in said axial direction of said combustion chamber and said heat exchanger are the same.

19. The hot-air furnace of claim 10, wherein said heat exchanger has at a junction with said combustion chamber air ventilation and heat transfer pipes which traverse said heat exchanger between opposite sides thereof, said pipes being inclined at an acute angle to the horizontal and being at right-angles to said axial direction.

20. An assembly comprising first and second hot-air furnaces arranged in parallel, each hot-air furnace including:

a casing having a top and a bottom and containing an elongated combustion chamber below and connected to a heat exchanger;

a long-flame burner connected to said combustion chamber to propagate a flame in an axial direction which is horizontal;

said combustion chamber having a length in said axial direction which is greater than both the height of said combustion chamber in a vertical direction and the width of said combustion chamber in a horizontal direction at right-angles to said axial direction;

an exhaust port located above said combustion chamber and extending from the top of said casing for exhausting combustion gases from said heat exchanger;

an air supply duct having a first portion circumjacent said exhaust port and a second portion communicating with said blower for supplying air thereto;

an air intake port adjacent he bottom of said casing;

an air discharge port adjacent the top of said casing;

a blower located between said air intake port and said combustion chamber for directing air to be heated upwardly through said casing in heat exchange relationship with said combustion chamber and said heat exchanger;

an air flow guide plate disposed between said casing and said combustion chamber and between said casing and said heat exchanger;

a radiant heat absorber plate disposed between said combustion chamber and said air flow guide plate with said air flow passing on opposite sides of said radiant heat absorber plate;

said heat exchanger having a length in said axial direction greater than the maximum width of said heat exchanger in said horizontal direction at right-angles to said axial direction;

the width of said heat exchanger decreasing as said heat exchanger extends away from said combustion chamber, and said heat exchanger being provided with a plurality of extending parts to enhance heat transfer between said heat exchanger and said air; and a plurality of inclined ventilation and heat transfer pipes passing through said heat exchanger and opening into a space between said heat exchanger and said casing on each side of said heat exchanger; and wherein a first control is provided for setting the output of the burner of said first hot-air furnace at a selected level, and a second control is provided for setting the output of the burner of said second hot-air furnace at a selected level independently of the setting of said first control, whereby the hot air output of said assembly can be varied.

* * * * *